United States Patent [19]

Kunieda et al.

[11] Patent Number: 4,603,509

[45] Date of Patent: Aug. 5, 1986

[54] MAGNETIC ATTRACTION SYSTEM GRINDING METHOD

[75] Inventors: Masanori Kunieda, Tokyo; Hiromichi Hiramatsu; Toshiro Higuchi, both of Yokohama; Takeo Nakagawa, 223-4 Ichinotsubo, Nakahara, Kawasaki, all of Japan

[73] Assignees: Aida Engineering, Ltd., Sagamihara; Takeo Nakagawa, Kawasaki, both of Japan

[21] Appl. No.: 579,877

[22] Filed: Feb. 13, 1984

[30] Foreign Application Priority Data

Mar. 4, 1983 [JP] Japan ..... 58-35612

[51] Int. Cl.[4] ..... B24B 1/00

[52] U.S. Cl. ..... 51/31; 51/56 R; 51/59 R; 51/71; 51/362; 51/281 R

[58] Field of Search ..... 51/110, 209 R, 59 R, 51/7, 165.76, 165.77, 31, 56 R, 71, 362, 281 R

[56] References Cited

U.S. PATENT DOCUMENTS

| | | | |
|---|---|---|---|
| 1,833,360 | 11/1931 | Fox | 51/56 |
| 2,056,182 | 10/1936 | Gardner | 51/209 R |
| 2,195,049 | 3/1940 | Wallace | 51/59 R |
| 4,150,511 | 4/1979 | Khokhulin | 51/59 R |

FOREIGN PATENT DOCUMENTS

| | | | |
|---|---|---|---|
| 1000246 | 3/1983 | U.S.S.R. | 51/7 |

OTHER PUBLICATIONS

Application-Orientated Standard Robot Packages, Lars-Erik Ringstrom, 12th International Symposium on Industrial Robot, 6th International Conference on Industrial Robot Technology Jun. 9-11, 1982, Paris, France.

Second Generation Robots—Research and Some Applications in the GDR, M. Zecha, K. Fritzsch, A Schwarz, 12th International Symposium, supra, pp. 311-319.

Tool Oscillation and Tilt Angle Control for Curved Surface Polishing, K. Noto, K. Kawai and M. Watanabe, Annals of the CIRP. vol. 31/1/1982, pp. 229-232.

*Primary Examiner*—Harold D. Whitehead

*Attorney, Agent, or Firm*—Holman & Stern

[57] ABSTRACT

A magnetic attraction system grinding method and apparatus comprised of arranging a magnetic circuit forming means between an abrasive tool and a workpiece, thereby generating a grinding pressure required to grind the surface of the workpiece, and performing the operation of the abrasive tool through a rectilinearly reciprocating movement or rotary movement working along the workpiece surface during the application of grinding pressure while controlling either grinding speed or grinding stroke. The magnetic circuit is produced with an electromagnet or permanent magnet assembly and the abrasive tool may be a magnetic material bonded grindstone.

19 Claims, 17 Drawing Figures

FIG.7
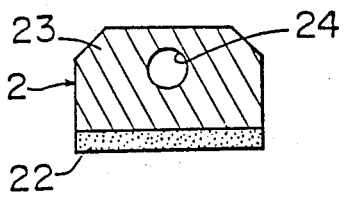
FIG.7a
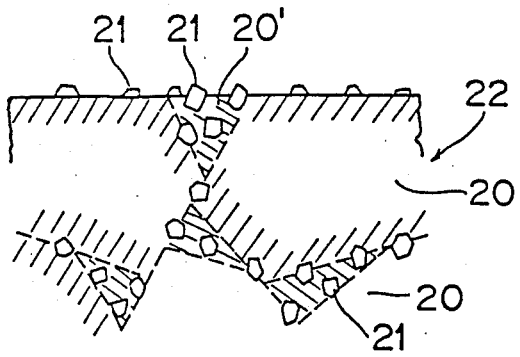
FIG.8
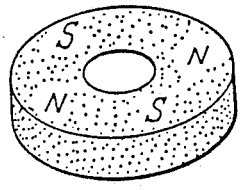
FIG.9a
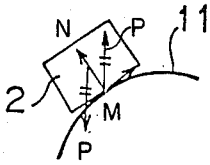
FIG.9b
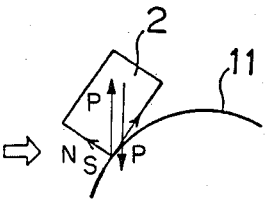
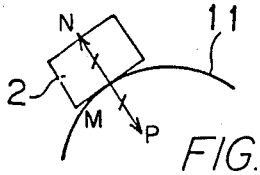
FIG.9c

MAGNETIC ATTRACTION SYSTEM GRINDING METHOD

BACKGROUND OF THE INVENTION

1. Field of the Invention

The present invention relates to a grinding method to grind a workpiece of ferrous and/or non-ferrous metals, alloys containing at least one or more materials including these metals and/or others, with the use of a magnetic attraction system.

2. Description of the Prior Art

Although a machining process has rapidly been automated and a machining accuracy has also been greatly improved as a popularization of NC machine tools or the like goes on, grinding or polishing operations are still taking an important role in final finishing processes, which are at present almost always carried out by manual methods requiring much time and labor.

Analyzing these manual finishing-works from a viewpoint of performance, most are characterized by a monotonous pattern to repeat a rectilinear motion while pressing a grindstone on a surface to be ground and in general the rectilinear motion itself is relatively simple. Accordingly if the user attaches a grinding tool to an end of a robot arm and teaches such rectilinear motion to the robot and re-enacts it, an automatization of the grinding process will soon be possible to be realized. For instance, a "dead-weight" system is one of the so-contrived grinding methods, in which a grindstone loaded with a certain weight is fitted to an end of the robot arm which is actuated to X- and Y-directions of the coordinates.

In this "dead-weight" system, however, the whole weight of grinding tool itself becomes considerably heavier and also a moment of inertia affected on the arm becomes too large because a grinding pressure is produced by a loaded weight. Consequently it is impossible to move the grindstone rapidly and stably on the surface to be ground and in the worst case it may happen that the grindstone leaps up or rebound from the surface to be ground. This inevitably results in a deterioration of the grinding performance. Also, since a spring force system will be most likely formed in a pressing means of the grindstone as a result of the employment of a weight, the frictional vibration at the time of grinding becomes larger because it is superposed upon a natural vibration of the arm. In addition to the above, there may be some cases where several laterally-striped patterns are created perpendicularly against a grinding direction along the surface to be ground and in consequence an optional grind surface is hard to be obtained.

Also, in actual cases there are many varieties in the shape of workpiece surfaces, e.g., as typified in dies or the like, in which not only a simple straight-surface but also a complex curved-surface or a combined pattern thereof are included, and their patterns are often formed not merely on a plane surface but on a side or cavity surface.

If the surface to be ground comprises such a complicated pattern, the grinding motion will inevitably be affected by gravity of the weight load. As a result, it becomes impossible to do grinding of a side surface and also a profiling of a free curved surface. Especially, there will be such cases where a proper grind can not be attained because a grinding pressure is affected by an inclination of the surface to be ground and in consequence can not be loaded evenly on the workpiece surface.

BRIEF SUMMARY OF THE INVENTION

It is, therefore, a primary object of the present invention to eliminate the defects of the prior art as outlined above and to provide such an appropriate and improved grinding method for users that the inertia and reaction forces are scarcely produced and frictional vibrations are hardly ever caused even under severe grinding conditions, and the grinding pressure is kept constant and the grinding performance suits the profiling work of free curved surface or side surface and the grinding work of dies or the like as well as the same work by a robot.

It is another object of the present invention to provide a new and efficient grinding tool and automatic grinding apparatus having the aforementioned various features of design and grinding method embodied therein.

In order to attain these objects, the present invention intends to make a change in the concept of the prior art that the grinding pressure may be obtained by a pressurization from external equipment and to provide a new method and an apparatus contrived to obtain the grinding pressure by an attractive force to magnetically attract the grindstone onto a surface of the workpiece. That is to say, this method under the present invention is to perform the grinding work by a mechanism and its operation contrived to move the grindstone along the surface of the workpiece to be ground by the aid of a magnetic circuit formed between an abrasive tool and a workpiece.

BRIEF DESCRIPTION OF THE DRAWINGS

The present invention, both as to its mechanism and grinding method, together with further advantages thereof, will be more fully understood by reading the following detailed description with reference the accompanying drawings, wherein;

FIG. 7 is a longitudinal cross-sectional side view showing an example of a grindstone employed in the present invention;

FIG. 7(*a*) is a partial enlarged cross-sectional view of the grindstone of FIG. 2;

FIG. 8 is a perspective view showing another example of a grindstone employed in the present invention;

FIGS. 9(*a*), 9(*b*) and 9(*c*) are schematic views which show a curved surface profiling work, respectively, and, more particularly in FIGS. 9(*a*) and 9(*b*) a conventional dead-weight system's or spring system's grinding work and in FIG. 9(*c*) a magnetic attraction system's grinding work of the present invention;

DETAILED DESCRIPTION OF THE INVENTION

The present invention will now be described in further detail as to the specific embodiment in connection with the accompanying drawings.

Figure 1:
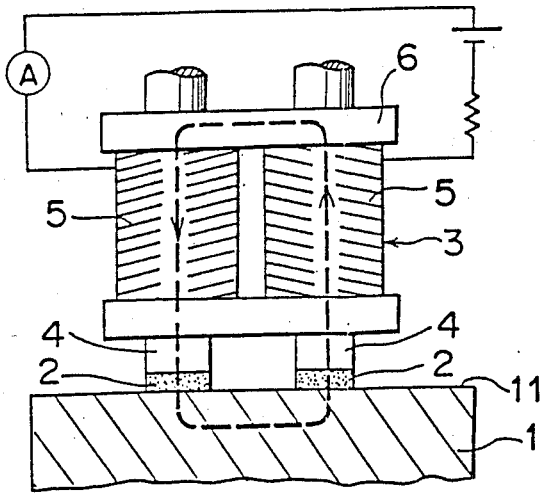
FIG. 1 is a schematic illustration of an embodiment of the invention wherein a magnetic circuit is formed with the use of an electromagnet.
Figure 14:
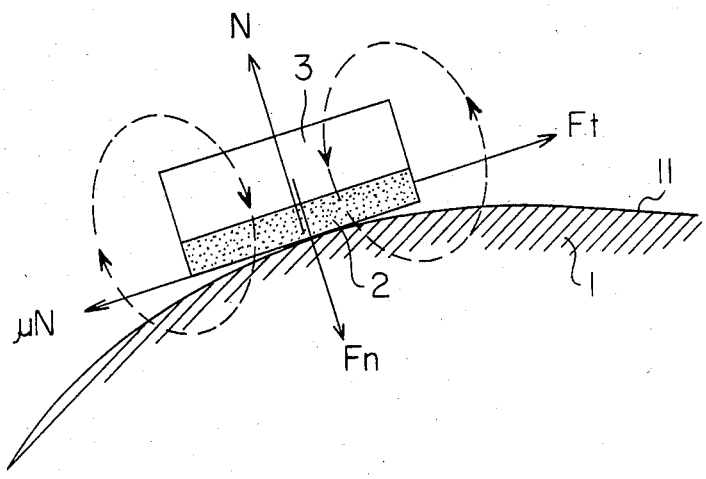

Referring initially to FIGS. 1 and 14, the magnetic attraction system grinding method is in principle shown therein. Reference number 1 indicates a given magnetic-material-bodied workpiece such as dies or the like to be ground, 2 is a grindstone and 3 is a magnetic circuit forming means such as a magnet. The grindstone elements 2 & 2 are installed at each end of the magnetic circuit forming means 3. Although a polishing work is generally carried out through a resultant factor of a pressing force, i.e., grinding pressure "Fn" to press the grindstone 2 against the workpiece surface 11 and a moving force "Ft" to move the grindstone 2 tangentially on the workpiece surface, the method and apparatus of the present invention are contrived to make it possible to grind the surface 11 of the workpiece with the abrasive particles contained in the grindstone 2 with a mere operation to slide both the grindstone 2 and magnetic circuit forming means 3 along the workpiece surface 11 through such a contrivance that the magnetic circuit as shown by broken line is initially formed between the grindstone 2 and the workpiece 1 with the use of magnetic circuit forming means 3 and and the grinding pressure required to grind the workpiece is produced by the magnetic attraction force Fn to press the grindstone 2 against the surface 11 of the workpiece.

In this way, according to the present invention, the magnetic attraction force Fn can be produced in the normal line direction on the grindstone 2 without using another pressing means for pressing the grindstone 2 against the workpiece 11, so that the grindstone can be pressed constantly in the normal line direction of the workpiece surface 11 in such a condition that the grindstone 2 corresponds to a configuration of the workpiece surface 11 and its pressing force is always counterbalanced to a state of the workpiece surface.

Thus, the magnetic attraction system grinding method under the present invention obviates the need for a separate pressing device, so that the machine itself can be constructed simple and compact. This makes it possible to carry out the grinding work with a mere operation to move the grindstone 2 tangentially on the workpiece surface by the moving force Ft with the use of a simple robot because any type of control means for turning and pressing the grindstone in the normal line direction of the workpiece surface is needless.

Furthermore, the present invention has the features that the grinding work of a free curved-surface or side surface can easily and stably be carried out, as well as a plane surface, because the magnetic attraction force Fn acts on the grindstone 2. With regard to the grinding work for the free curved surface or side surface, in a method wherein an external force is applied to the grindstone as in a conventional dead-weight system, it is difficult to direct the pressing force P (see FIG. 9) in the normal line direction N even if the grinding pressure is applied in the normal line direction N by pressing a central portion M of the grindstone 2 against a free curved surface of the workpiece 11 as in FIG. 9(*a*), so that an edge S of the grindstone 2, for example as in FIG. 9(*b*), comes to strike against a surface of the workpiece surface 11 and motion of the grindstone to trace a contour of the workpiece 11 becomes unstable. As a result, a moving position of the grindstone is sometimes apt to slip out of a required grinding spot and a fluctuation of grinding pressure tends to be brought about. These defects naturally deteriorate the quality of grinding, thus resulting in a creation of inferior products.

On the contrary, in the invention, the magnetic attraction force P acts on the grindstone 2 in the normal line direction N of the workpiece surface 11 as seen in FIG. 9(*c*), so that no fluctuation occurs at the grinding spot M and in grinding pressure P. Consequently a profiling machinability is greatly heightened. This effect can further be enhanced by making an iron-core or permanent magnet, which is manufactured monolithically with or attached to the grindstone 2, freely movable in the axial directions or by making the grindstone 2 rotatable with a bottom portion of the iron-core or permanent magnet as a center of the rotation. In this way, according to the invention, the grindstone 2 can always be moved to follow a free curved-surface of the workpiece 11 exactly and stably, thus ensuring obtaining an excellent polishing result.

In the embodiment, of FIG. 1 an electromagnetic system is employed as the said magnetic circuit forming means. The grindstone elements 2 & 2 are installed at the bottoms of core elements 4 & 4 and the coil elements 5 & 5 are wound up around said core elements 4 & 4 which are combined by a connector means 6. The magnetic circuit is thus integrated by such arrangement of core elements 4 & 4, connector means 6, grindstone elements 2 & 2 and workpiece 1.

Figure 2:
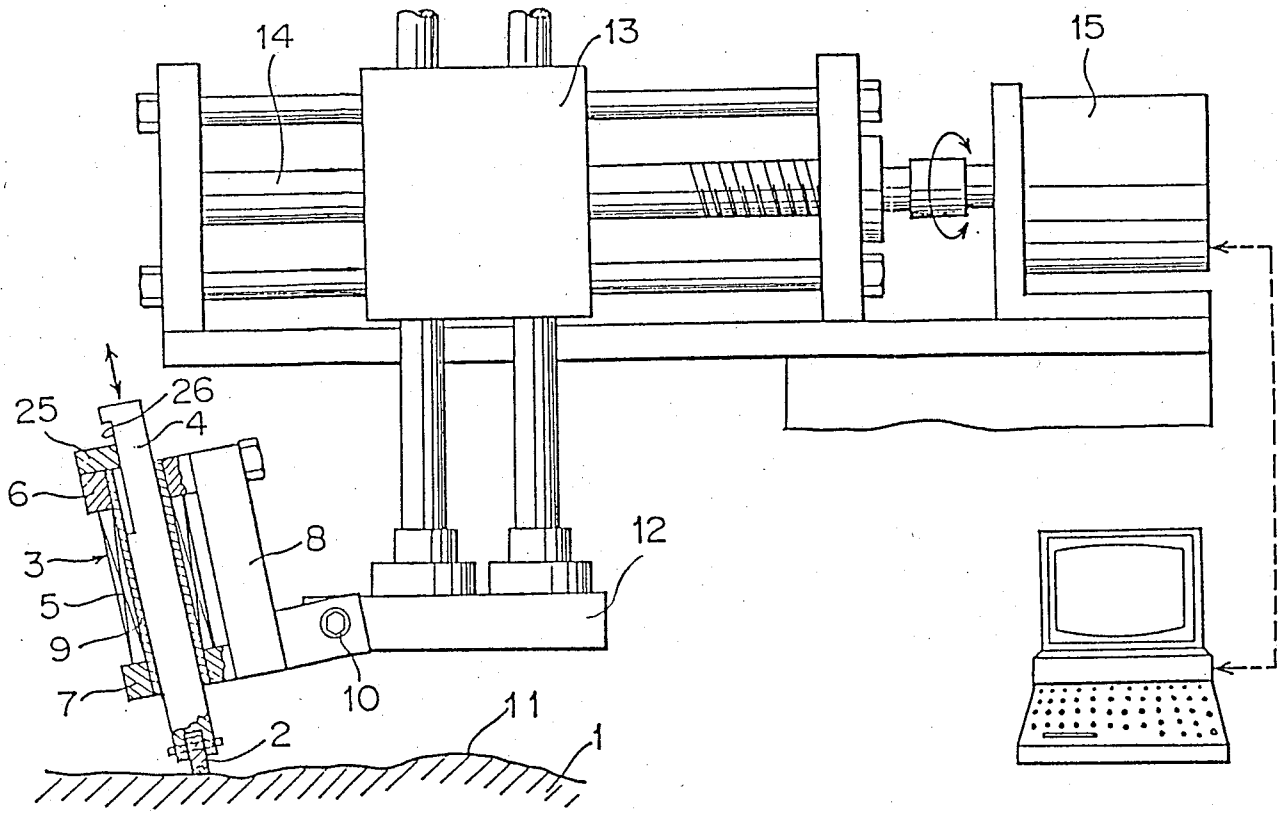
FIG. 2 is a partially cross-sectional side elevation view showing an example of a grinding tool and grinding apparatus embodying the features of the present invention.
Figure 3:
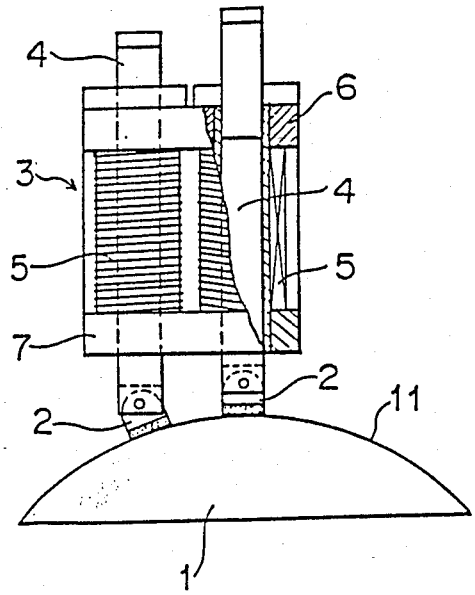
FIG. 3 is a partially cross-sectional front elevation view showing a principal part in FIG. 2.

Referring now to FIGS. 2 & 3, each example of grinding tool and automatic grinding apparatus which embody the features of the present invention is illustrated therein. A lower connector means 7 made of non-magnetic material, e.g., aluminum alloy, etc. is arranged opposite to the aforementioned connector means 6. This lower connector means 7 is coupled with the connector means 6 by using a binding member 8 and the thus coupled member serves as a holder of the magnet assembly. Further, a sleeve 9 made of brass or other metals having a minor friction coefficient is fitted between said connector means 6 and lower connector means 7. A coil 5 is wound up around an outer circumference of this sleeve 9, while the aforementioned core 4 is arranged to freely move in the axial directions through the inside of this sleeve. The grindstone 2 is attached pivotably to the bottoms of the core elements 4 & 4 respectively.

The aforementioned holder is connected to an arm 12 through a joint section 10. A screw shaft 14 is screw-connected to a slide 13 located at the rear side of this arm 12 and also an end of the screw shaft is connected to a reversible motor 15. The reversible motor 15 provides a reciprocating movement for the slide 13 through normal and reverse revolutions of the screw shaft 14 and a sliding movement for the grindstone 2 along the surface 11 of workpiece through the arm 12 and the holder 8. During these operations, when power is produced in the coil, the grindstone 2 will be attracted directly to the surface 11 of the workpiece, and thus the grinding pressure can be produced.

Incidentally, it goes without saying that a mechanism to move the arm and the holder may be set up by an optional construction.

Figure 4:
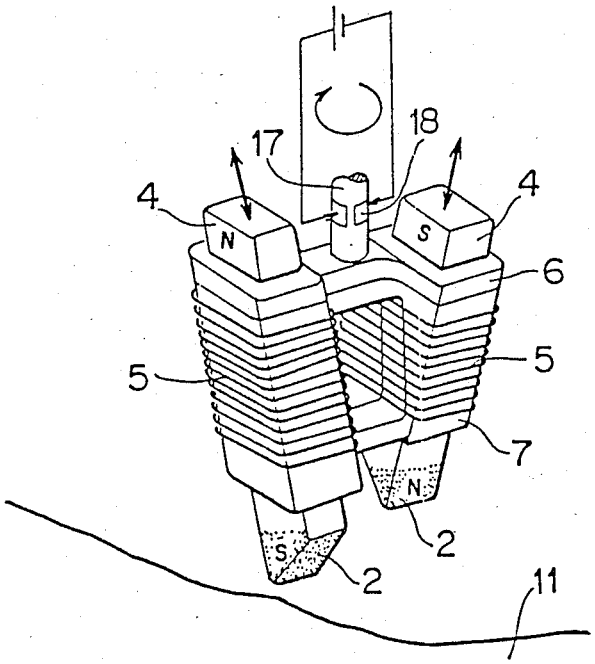
FIG. 4 is a perspective view showing an example of a magnetic circuit for a rotary movement system.

Referring next to FIG. 4, an embodiment wherein the movement of grindstone 2 to slide along the surface 11 of the workpiece is performed by a rotary movement instead of rectilinearly reciprocating movement is illustrated therein. In this embodiment, the coil elements 5 & 5 are wound up around the outer circumference of the lower member (lower holder) 7, and the core elements 4 & 4 are inserted through each member of the upper holder 6, coil 5 and lower holder 7. A revolving shaft 17 having a brush 18 is inserted through the upper holder 6.

Figure 5:
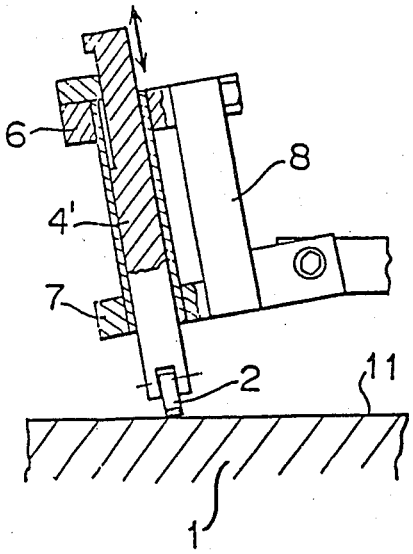
FIG. 5 is a cross-sectional elevation view of a principal part showing an example comprised of the magnetic circuit with a permanent magnet.
Figure 6:
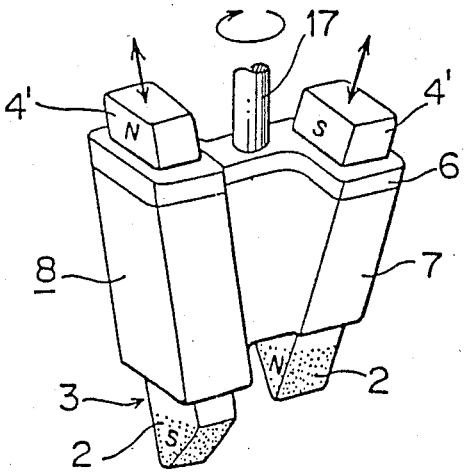
FIG. 6 is a perspective view showing an embodiment of the permanent magnet and the rotary movement system.

Referring then to FIGS. 5 and 6, an embodiment employing a permanent magnet system as the magnetic circuit forming means is illustrated therein FIG. 5 shows an aspect to rectilinearlly reciprocate the grindstone along the surface, and FIG. 6 shows an aspect arranged to rotate the grindstone. In either embodiment, the grindstone 2 is arranged fixedly or movably under the permanent magnet 4' which is attached movably in the axial directions to the holder 8. With regard to the other parts, suffice it to say that they are shown with the same reference numbers as those of the foregoing electromagnetic system.

In each drawing of FIG. 1 through FIG. 6, the grindstone 2 has a shape formed by coagulating the particles of the grindstone with a bonding agent. In the case of a thin-shaped grindstone, it may be allowable to use a non-magnetic material as the bonding agent. However, in order to enhance the attractive force of the grindstone to the surface 11 of the workpiece, it is desirable to use a magnetic material as the bonding agent. As a typical example, a cast iron metallic powders bonded grindstone as shown in FIGS. 7 and 7(*a*) has been known.

This cast iron metallic powders bonded grindstone is manufactured in such a process that the cast iron powders having a fixed particle size are initially mixed with the grindstone particles and/or further carbonyl iron powders in addition to the same and its mixture is then press-formed and finally sintered under a reducing atmosphere. And at the time of sintering, the grindstone particles 21 are retained on the cast iron base 20 as shown macroscopically in FIG. 7(*a*). In relation to this, if the carbonyl iron powders are added into the cast iron powders, the said retaining force will be strengthened further because the minutest vacant spaces between the cast iron powders and the grindstone particles are filled up with the particles of a newly formed cast iron matter 20' which is produced by chemical reaction of the added carbonyl iron powders and the carbon powders contained in the cast iron powders.

When this cast iron powders bonded grindstone is employed instead of the conventional grindstone, many advantages will be obtained such that a clogging between the grindstone particles is hardly caused and the grindstone itself is difficult to be worn away. Also magnetic permeability is considerably high and in consequence provides a larger attractive force (grinding pressure) to the grindstone than that of a conventional grindstone even when impressed with the same current or the same magnetic force to the two grindstones because the cast iron is employed in the base metal. Incidentally, it goes without saying that a grindstone-particle-containing-magnet can be used for this purpose which is made by mixing the grindstone particles with the magnet composing iron powders and sintering its mixture.

This example is given in FIGS. 4 and 6. In an embodiment shown in FIG. 7, a base metal 23 made of the cast iron matter is mono-block formed together with the grindstone member 22 and a through-hole 24 for a pivot pin is bored in this base metal 23. Needless to say, it is possible to bond or stick the base metal 23 to an end of the core 4 or the permanent magnet 4'. In such a case that the grindstone and the permanent magnet are combined in one as in FIGS. 4 and 6, it is desirable to form the grindstone 22 containing the grindstone particles only at the bottom portion.

In each example in FIGS. 1 through 6, the coil 5, core 4 and permanent magnet 4' are respectively composed of plural sets for the reason that the magnetic circuit must be formed between the grindstone 2 and the surface of workpiece 1, however, when they have a plurality of S/N polarities as in FIG. 8, it is warrantable to form them in a shape of mono-block construction. In this case, there is no objection even if the magnet is of a grindstone particles containing type.

Although the present invention has been outlined as above with regard to a major part of its mechanism, for the other mechanical descriptions, suffice it to say that a numeric number 25 shows a non-slip key and likewise 26 is a swivel arrester.

Next, the present invention will be explained mainly as to its function. The grinding operation according to the invention, as previously described, is carried out by initially forming a magnetic circuit between the grindstone 2 and the surface 1 of workpiece, thereby producing a magnetic attraction force therebetween without giving such external forces as a weight, spring force or fluid power to the grindstone so as to produce a grinding pressure. For this reason, a reaction force to the arm and other members for moving the grindstone is scarcely produced and their inertia force also becomes smaller. Accordingly, a dynamic performance when moving the grindstone at high speed is considerably improved, thus assuring an ease-of-control of the grindstone for the users.

Also, the grinding pressure is given by magnetic attraction force produced between the grindstone and the surface of workpiece and the external force is required merely for moving the "grindstone as a rigid body" horizontally, so that a spring force system is never formed between the grindstone and the workpiece and in consequence a frictional vibration is difficult to produce and also a lateral-striped pattern that might be created due to such frictional vibration can be greatly reduced. Especially, as the core 4 and the permanent magnet 4' are arranged to be movable according to a displacement of the workpiece surface to the normal line directions, a finish quality of the products can drastically be improved even in the case of grinding a curved surface.

Further, the present invention provides an ideal method to arrest a creation of the aforementioned lateral-striped pattern by setting at random either *one* and/or more advantageously *both* of the moving stroke frequency (at the returning point) of the grinding tool including grindstone or the moving speed. Although the grinding work is practically finished by abutting one grind segment after the other subsequent grind segment seamlessly, if the moving stroke is constant, it is feared that a boundary line or a clear distinction is created between one grind segment and another grind segment when their ends abut each other. To avoid this drawback, it is advisable to set the moving stroke at random every segment. This control can easily be carried out through the instructions of a microcomputer or the like.

Furthermore, as the method of the present invention provides a grinding pressure by the magnetic attraction force to attract the grindstone onto the surface of the workpiece, it is feasible not only for a plane surface but also for a side surface or curved surface. However, in the method of the prior art such as a dead-weight system, spring force system or the others which employ any external force for the grinding pressure, a grinding point is apt to slip out of the position in a normal line direction due to a displacement of the workpiece surface, as seen in FIG. 9(*a*). This brings about a fluctuation in the grinding pressure and in consequence deteriorates the quality of profile grinding, thus resulting in a creation of inferior products. On the contrary, in the method of the present invention, there are no fluctuations of the grinding point and grinding pressure because the attractive force "P" which is in diametrically opposite relation to the normal line force, as in FIG. 9(*b*), influences the grindstone 2, and in consequence a superior profile grinding can be attained. This can be made more efficient by arranging the core and/or the permanent magnet, which have a unitized or combined relation with the grindstone 2, movable in the axial directions, or otherwise by arranging the grindstone 2 rotatably with the bottom end of the core or the permanent magnet as a center. Thus, the method of the present invention can be applied even for the grinding work of complicated curved surfaces.

In addition to the above, the method of the present invention has further such an outstanding advantage that the workpiece 1 is hard to be magnetized because the reciprocating or rotating movement is given only to the grindstone 2 but not given to the workpiece though the magnetic circuit is formed between the grindstone 2 and the workpiece 1. In one of the embodiments where the inventors have performed a grinding work for a workpiece of SK-material ($150\times80\times3^t$), the magnetic force values measured before and after the grinding are both 1 or 5 G. This means that there is no difference in magnetic force before and after the grinding. Accordingly, it is advisable to use an AC current for generation of the magnetic force or to grind the workpiece further at a working space of N-polarity following after completing the grind at a working space of S-polarity.

Moreover, in the case where the magnetic circuit is composed of an electromagnet system of the present invention, the grinding pressure can easily be controlled by detecting a variation of current value supplied to the coil 5. This system has further an excellent advantage that a disposition of the chips can easily be carried out. That is to say, when a large quantity of chips are produced and adsorbed to the magnet assembly, such adsorption of the chips brings about a power interruption, i.e. a demagnetization of the magnet, which causes the grinding area to release and make it easy to eliminate the chips out of the grinding area. On the other hand, in the case of the permanent magnet system of the present invention, the grinding pressure is impossible to be changed during the operation but an overall construction of the magnetic circuit can be integrated simply and lightly in weight.

The method and apparatus according to the present invention can be applied for various factory works such as a scalar type or a rectangular coordinates type robot works as well as an internal grinding or other general grinding works, and make it possible to use a magnetic file, magnetic grindstone, magnetic sand paper and so on for such grinding operations.

The present invention will finally be described in further detail on the basis of several exemplification tests in connection with the accompanying drawings.

(1) A grinding experiment has been carried out with the use of a certain grinding machine as shown in FIGS. 2 and 3. This experiment has been practiced under the strictly controlled fundamental conditions, namely, the slide is reciprocated by a microcomputer-controlled DC motor; the magnetic attraction force of the grindstone is controlled by a DC powered solenoid coil; and the horizontal movement of the grindstone is performed by an X-Y coordinates table.

(2) A cast iron powders bonded grindstone containing a diamond has been employed in this experiment. The size of grindstone was 15 mm×10 mm×10 $mm^t$ and an appropriate quantity of grindstone particles were retained only in the part 1.5 mm deep of the superficial layer. The grindstone was made of a mixture of 7.5 wt % grindstone particles, 10 $\mu m$ $\phi$ 22.5 wt % carbonyl iron powders and cast iron powders passed through No. 200 mesh sieve, and press-formed together with cast iron base powders, and then sintered under the temperature of 1140° C.

Two workpieces of SK-material (Hv181) and prehardened steel (Hv489) were provided for this experiment. Also, an appropriate quantity of light-oil was used as an abrasive oil. The experiment was applied to a side surface of a R75 mm cylinder at the speeds of 4.5–8 m/min. The electromagnet assembly was composed of the core elements having a distance between cores of 32 mm and the coil elements of 40 mm high, and set up at the inclination angle of 15 degrees from the joint section.

Figure 10:
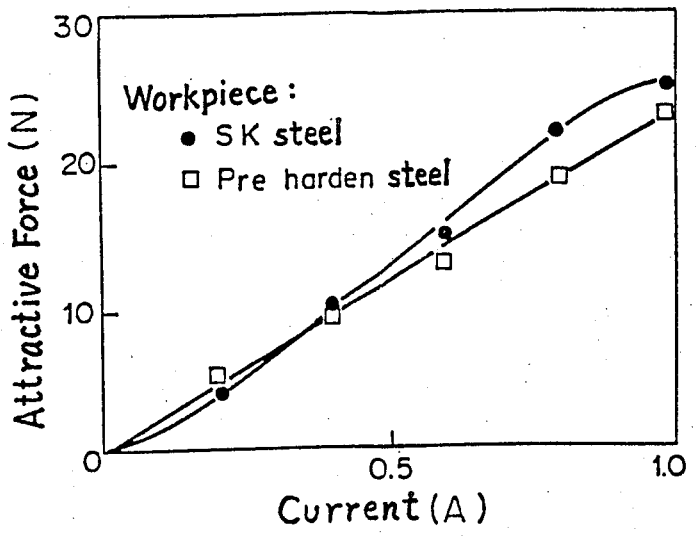
FIG. 10 is a graph showing a relationship between a supply current and an attractive force of the grindstone in the grinding method of the present invention.

(3) FIG. 10 shows a relationship between the current supplied to the coil and the magnetic attraction force to the grindstone (grinding pressure). As can be understood from FIG. 10, a powerful grinding pressure is obtained because a cast iron powders bonded grindstone is employed in this experiment.

Figure 11:
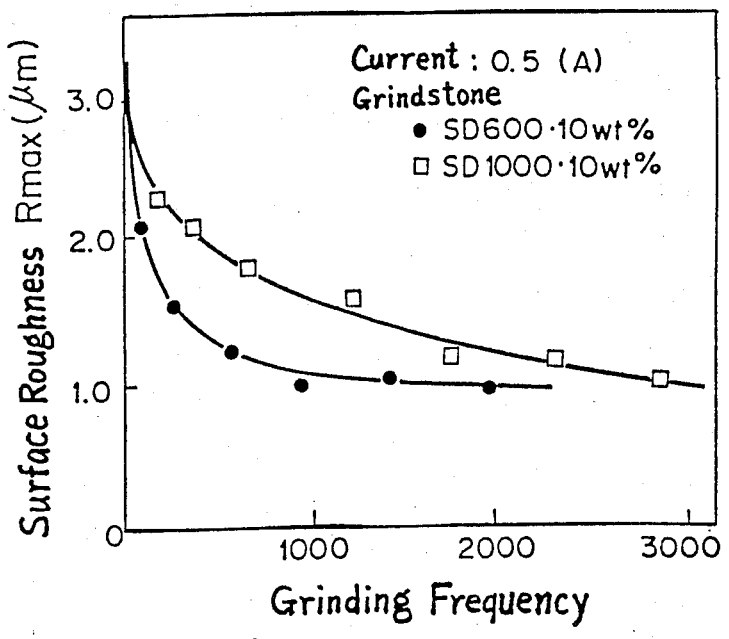
FIG. 11 is a graph showing a relationship between a particle size of grindstone and grinding performance.
Figure 12:
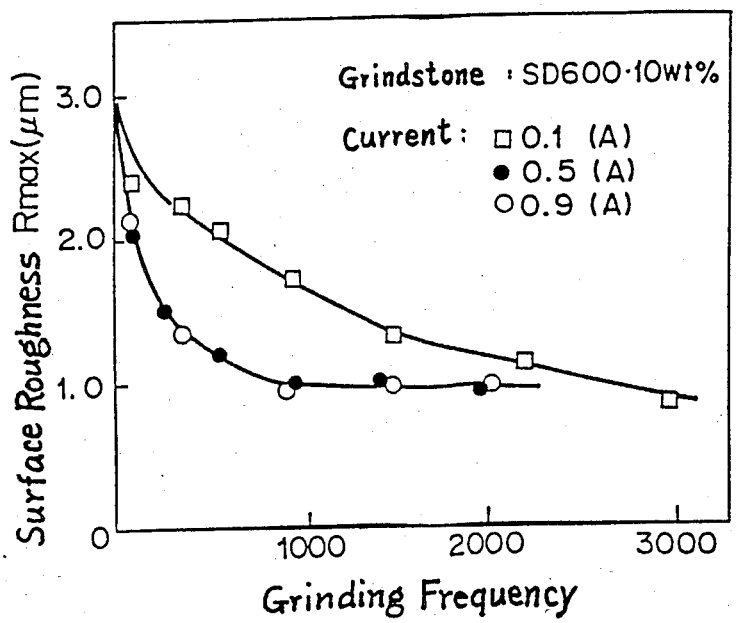
FIG. 12 is a graph showing a relationship between a supply current and the grinding performance.
Figure 13:
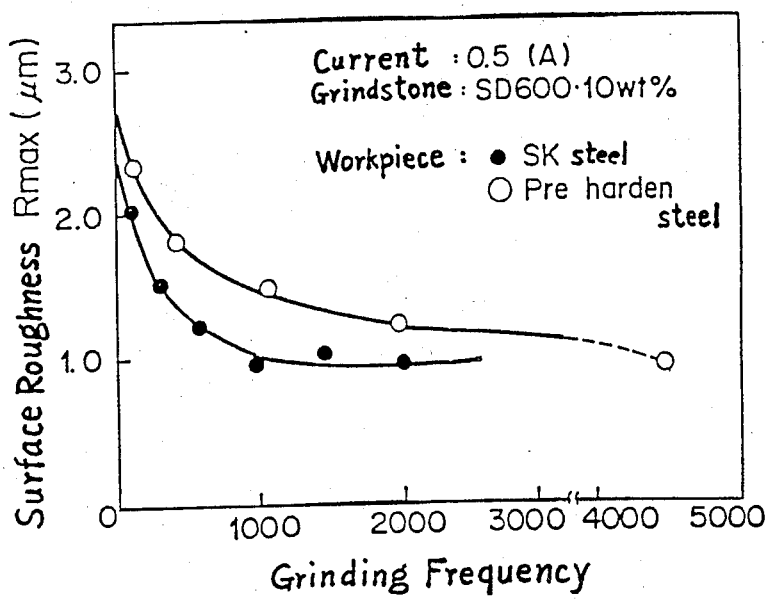
FIG. 13 is a graph showing a relationship between a change of material quality and the grinding performance and FIG. 14 is a schematic illustration showing a fundamental principle of a magnetic attraction system grinding method under the present invention.

Referring next to FIGS. 11 through 13, each results of the experiments practiced under the aforementioned conditions is given therein. In these drawings, the grinding frequency in the axis of abscissa shows a frequency where the grindstone passes a returning point. FIG. 11 shows a difference of grinding performance made by the variation of grindstone particle size; FIG. 12 shows a difference of grinding performance made by the variation of supply current; and FIG. 13 shows a difference of grinding performance made by the variation of material quality respectively. The results show, throughout all of the experiments, that a curvature of the side surface can also be ground effectively which is difficult to perform by the dead-weight system and that lateral-striped patterns are scarcely created in said surface because the frictional vibration problems are also hardly caused by the grinding work. Thus a superior effect of this method has completely been exemplified. Incidentally, the reason why no difference could be found in performances between both tests of 0.5 A and 0.9 A is that the process efficiency already reached a saturation just at that grinding pressure.

(4) As has been understood, the lateral-striped patterns are scarcely created but, in order to eliminate them completely, the exemplification tests have been carried out under the following three conditions instead of the fixed conditions (i.e. grinding speed: 8 m/min, stroke length: 50 mm);

(a) the grinding speed is constant and the stroke length is random (50 mm±10 mm), (b) the grinding speed is 4.5–8 m/min and the stroke length is constant, and (c) the grinding speed and the stroke length are both constant.

In these tests, the instruction of grinding speed and the positioning order of returning point are both given at random by the control from a microcomputer. A remarkable effect of this method was recognized in all of the tests, especially the best result has been obtained under the conditions of (c), where a boundary line between process segments could completely be eliminated because the stroke length was set at random.

As has been understood from the aforementioned detailed description, the magnetic attraction system grinding method and its apparatus according to the present invention can provide such various advantages for users that the inertia force and reaction force as well as the frictional vibration are scarcely produced and that the grinding pressure can always be maintained at a constant level which suits the state of side surface or free curved surface regardless of the inclination of the profiling surface. Also, the method and apparatus of the present invention enable making a grinding machine lighter in weight and smaller in size than any of the prior art conventional machines and also applying to all the abrasive works for dies and others with the use of a robot, thus assuring the best efficiency in grinding work for users.

We claim:

1. A magnetic attraction system grinding method comprising:

providing a grinding tool having a movable magnetic circuit forming means with an end juxtaposed with respect to a workpiece;

providing a magnetic material bonded grindstone on the end of the magnetic circuit forming means;

contacting the grindstone with the surface of the workpiece to be ground;

producing a magnetic circuit by the magnetic circuit forming means between the grinding tool and the workpiece to generate a grinding pressure of the grindstone on the surface to be ground; and producing relative movement between the grinding tool and the surface to be ground while maintaining said grinding pressure.

2. The method as claimed in claim 1 wherein, said relative movement comprises moving the grindstone tangentially on the surface of the workpiece in a substantially rectilinear reciprocating motion while tracing a path over the surface of the workpiece to be ground and producing a magnetic attraction force in a direction normal to the workpiece surface.

3. The method as claimed in claim 1 wherein, said relative movement comprises rotating the grindstone while tracing a path over the surface of the workpiece to be ground and tangentially thereto and generating a magnetic attraction force in a direction normal to the workpiece surface.

4. The method as claimed in claim 1 wherein said grindstone is movable by said magnetic circuit in a direction normal to the surface to be ground.

5. The method as claimed in claim 1 wherein said surface to be ground is a free curved surface and said magnetic circuit is applied to maintain said grinding pressure in a direction normal to said free curved surface in any position thereon.

6. A magnetic attraction grinding tool for grinding a surface on a workpiece comprising:

a holding means for at least one abrasive element;

at least one abrasive element mounted in said holding means;

manipulating means to which said holding means is attachable for supporting said holding means juxtaposed with respect to the workpiece, moving said holding means to move said at least one abrasive element into and out of contact with the surface on the workpiece to be ground, and moving said at least one abrasive element over said surface to grind said surface; and means on said holding means for forming a magnetic circuit between said holding means, said at least one abrasive element and said workpiece to produce a grinding pressure of said at least one abrasive element on the surface to be ground.

7. A grinding tool as claimed in claim 6 wherein:

said at least one abrasive element comprises an elongated magnetic core, a grinding end on said core for contacting the workpiece and an abrasive material on said grinding end; and said magnetic circuit forming means comprises a part of said holding means being made of magnetic material and arranged to guide magnetic flux in a circuit through said core, holding means and at least the surface of the workpiece to be ground, and means to produce said magnetic flux, so that said grinding pressure is normal to the surface being ground.

8. A grinding tool as claimed in claim 7 wherein:

said at least one abrasive element comprises two said magnetic cores in relative spaced relation;

said holding means comprises a non-magnetic member supporting said cores in spaced relation adjacent the grinding ends thereof, and a magnetic member in spaced relation to said non-magnetic member connected to and supporting said cores adjacent the other ends thereof; and the adjacent ends of said cores have opposite polarity.

9. A grinding tool as claimed in claim 8 wherein said cores are permanent magnets.

10. A grinding tool as claimed in claim 8 wherein said means to produce magnetic flux comprises electrical conduction coils wound around said cores and electrical power supply means operatively connected to said coils to produce two electromagnets.

11. A grinding tool as claimed in claim 8 wherein:

said holding means comprises two sleeve members held in spaced relationship by said magnetic and non-magnetic members; and said cores are slidably mounted within said sleeve members in a direction to maintain the grinding pressure normal to the surface being ground.

12. A grinding tool as claimed in claim 11 wherein said cores are permanent magnets.

13. A grinding tool as claimed in claim 11 wherein said means to produce magnetic flux comprises electrical conduction coils wound around said sleeve members and electrical power supply means operatively connected to said coils to produce two electromagnets.

14. A grinding tool as claimed in claim 6 wherein said manipulating means moves said holding means and said at least one abrasive element in a substantially rectilinear reciprocating motion while tracing a path over the surface of the workpiece to be ground.

15. A grinding tool as claimed in claim 12 wherein said manipulating means moves said holding means and said at least one abrasive element in a substantially rectilinear reciprocating motion while tracing a path over the surface of the workpiece to be ground.

16. A grinding tool as claimed in claim 13 wherein said manipulating means moves said holding means and said abrasive elements in a substantially rectilinear reciprocating motion while tracing a path over the surface of the workpiece to be ground.

17. A grinding tool as claimed in claim 6 wherein said manipulating means moves said holding means and said at least one abrasive element in a rotary motion while tracing a path over the surface of the workpiece to be ground.

18. A grinding tool as claimed in claim 12 wherein said manipulating means moves said holding means and said at least one abrasive element in a rotary motion while tracing a path over the surface of the workpiece to be ground.

19. A grinding tool as claimed in claim 13 wherein said manipulating means moves said holding means and said abrasive elements in a rotary motion while tracing a path over the surface of the workpiece to be ground.

* * * * *